US009731332B1

(12) United States Patent
Smith et al.

(10) Patent No.: US 9,731,332 B1
(45) Date of Patent: Aug. 15, 2017

(54) MATERIAL APPLICATOR AND MANIFOLD THEREFOR

(71) Applicants: Brent Edward Smith, Weston, MO (US); Travis Michael Budenbender, Lenexa, KS (US)

(72) Inventors: Brent Edward Smith, Weston, MO (US); Travis Michael Budenbender, Lenexa, KS (US)

(73) Assignee: Leading Edge Safety, LLC, Kansas City, MO (US)

( * ) Notice: Subject to any disclaimer, the term of this patent is extended or adjusted under 35 U.S.C. 154(b) by 0 days.

(21) Appl. No.: 15/455,049

(22) Filed: Mar. 9, 2017

(51) Int. Cl.
*B08B 5/02* (2006.01)
*B05C 17/00* (2006.01)

(52) U.S. Cl.
CPC ..... *B08B 5/02* (2013.01); *B05C 17/002* (2013.01)

(58) Field of Classification Search
CPC ..... B08B 5/02; B05C 17/002
USPC ..... 222/148, 145.2, 144.5, 145.5
See application file for complete search history.

(56) References Cited

U.S. PATENT DOCUMENTS 3,416,707 A * 12/1968 Pollard ..... B65D 83/682 222/1
4,440,320 A * 4/1984 Wernicke ..... B29B 7/7438 222/145.1
2013/0269806 A1 10/2013 Burns

* cited by examiner

*Primary Examiner* — Donnell Long
(74) *Attorney, Agent, or Firm* — Mashburn Law Office, LLC; Donna Denise Mashburn

(57) ABSTRACT

A material applicator comprising a manifold including a primary body and a gate. The primary body includes a first inlet channel, first inlet connecting geometry, a second inlet channel, second inlet connecting geometry, a third inlet channel, third inlet connecting geometry, a first outlet channel, a second outlet channel, outlet connecting geometry, and a gate cavity. The gate is positioned in the cavity and includes a number of through-channels. The gate is configured to shift between a substance delivery position and a flushing position.

17 Claims, 4 Drawing Sheets

MATERIAL APPLICATOR AND MANIFOLD THEREFOR

BACKGROUND

Embodiments of the present invention relate to material applicators for delivering or dispensing mixing fluids. Some mixing fluids harden or gum up in mixing manifolds or nozzles of the material applicators when the fluids stop flowing. The hardened mixing fluids must be cleared out of the manifold or nozzle by inserting a drill bit or other rod into the channels of the manifold. This is time consuming and can damage the manifold or nozzle. The drill bit or rod also can only go along a straight channel, so the manifold is manufactured to have straight channel sections and abrupt turns, which reduces flow of the mixing fluids. Other manifolds are simply discarded after a single or few uses.

SUMMARY

A material applicator and material applicator manifold for delivering two or more mixing substances is provided. An embodiment of the present invention is a material applicator manifold broadly comprising a primary body and a gate.

The primary body includes a first inlet channel, first inlet connecting geometry, a second inlet channel, second inlet connecting geometry, a third inlet channel, third inlet connecting geometry, a first outlet channel, a second outlet channel, outlet connecting geometry, and a gate cavity.

The first and second inlet channels receive substances such as to be mixed and pass into the gate cavity. The third inlet channel receives pressurized air, gas, or other fluid and also passes into the gate cavity. The outlet channels allow the substances to continue to a nozzle or similar dispensing component and pass out from the gate cavity. The gate cavity receives the gate and allows the gate to shift between a substance delivery position and a flushing position.

The gate is positioned in the gate cavity and switches between flow of the first and second substances and flow of the flushing fluid through the outlet channels. The gate broadly comprises a first through-channel, a second through-channel, a third through-channel, a handle, and stop. The gate may be configured to pivot or shift in relation to the primary body.

The first through-channel extends through the gate so as to connect the first inlet channel to the first outlet channel when the gate is in a substance delivery position. The second through-channel extends through the gate so as to connect the second inlet channel to the second outlet channel when the gate is in the substance delivery position.

The third through-channel extends through the gate so as to connect the third inlet channel to the first outlet channel and second outlet channel when the gate is in a flushing position. The third through-channel may be Y-shaped or may widen toward its downstream end so as to form a path from the third inlet channel to both the first outlet channel and the second outlet channel. The third through-channel may be angled or offset from the first through-channel and second through-channel so that the first through-channel and second through-channel do not form paths at the same time as the third through-channel.

Another embodiment is a material applicator broadly comprising a manifold as described above, first and second material dispensing valves, a valve bridge handle, and an extension arm. The first material dispensing valve is connected to the first inlet channel via the first inlet connecting geometry and the second material dispensing valve is connected to the second inlet channel via the second inlet connecting geometry. The material dispensing valves allow the user to control flow of the first and second substances to the manifold. The material dispensing valves also allow the substances to be shut off from the manifold when the manifold is being flushed. The valve bridge handle connects the first and second dispensing valves such that the valves are actuated simultaneously. The extension arm extends from the manifold and includes a hand grip and a forearm rest. The hand grip allows the user to aim the manifold and the forearm rest balances the weight of the manifold against a user's forearm.

This summary is provided to introduce a selection of concepts in a simplified form that are further described in the detailed description below. The summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
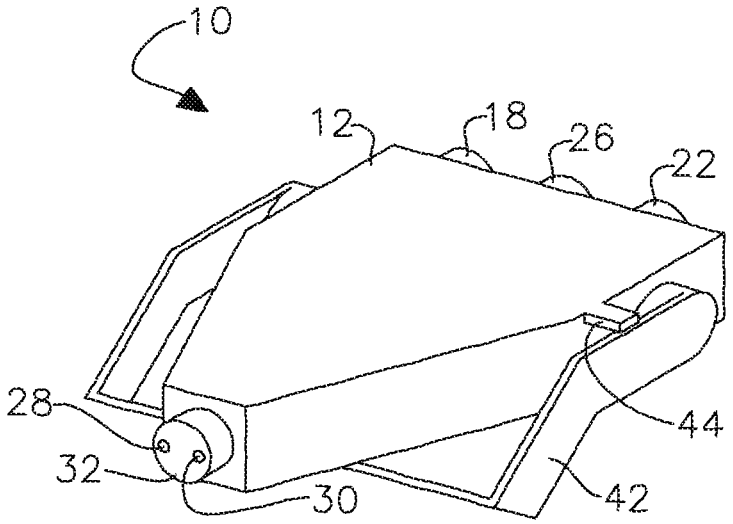
FIG. 1 is a perspective view of a manifold constructed in accordance with an embodiment of the present invention.
Figure 2:
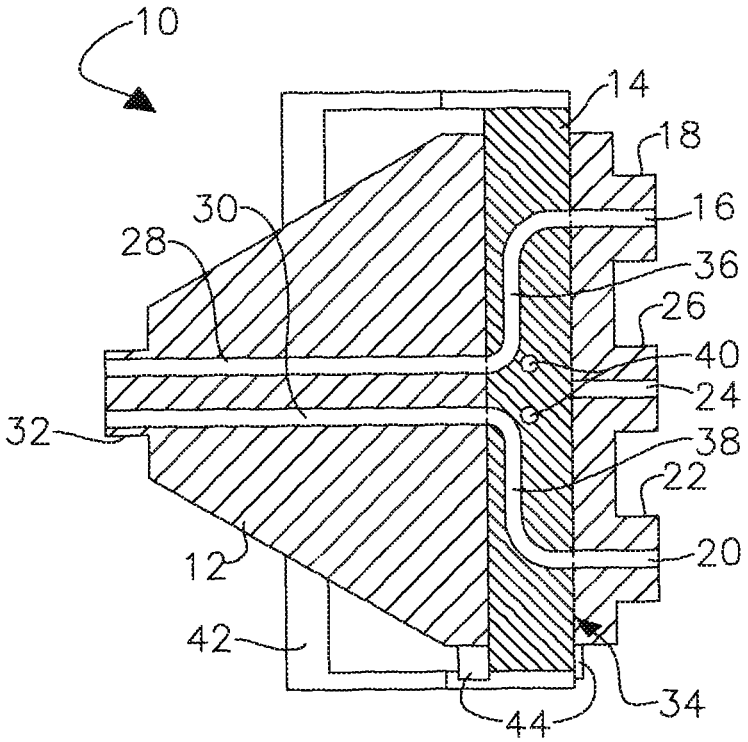
FIG. 2 is a partial cutaway plan view of the manifold in a substance delivery position.
Figure 3:
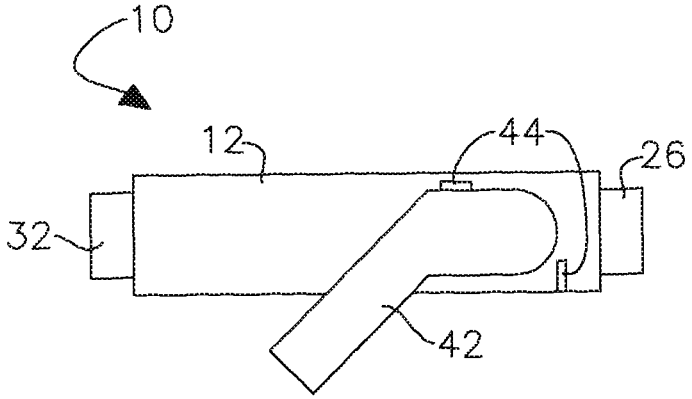
FIG. 3 is an elevation view of the manifold in the substance delivery position.
Figure 4:
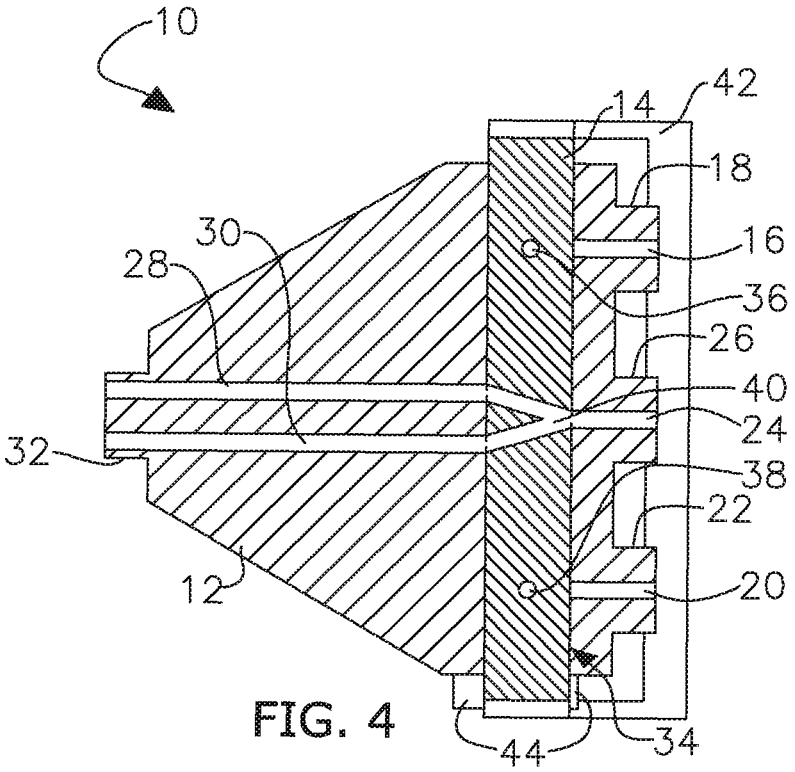
FIG. 4 is a partial cutaway plan view of the manifold in a flushing position.
Figure 5:
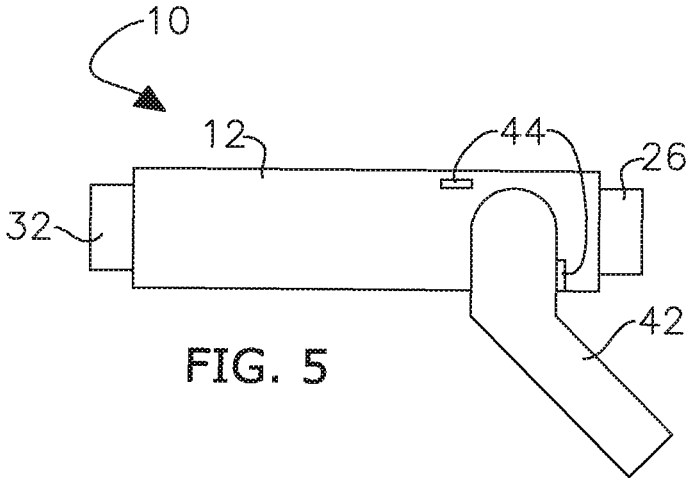
FIG. 5 is an elevation view of the manifold in the flushing position.

The drawing figures do not limit the current invention to the specific embodiments disclosed and described herein. The drawings are not necessarily to scale, emphasis instead being placed upon clearly illustrating the principles of the present invention.

DETAILED DESCRIPTION OF THE EMBODIMENTS

The following detailed description of the present invention references the accompanying drawings that illustrate specific embodiments in which the present invention can be practiced. The embodiments are intended to describe aspects of the present invention in sufficient detail to enable those skilled in the art to practice the present invention. Other embodiments can be utilized and changes can be made without departing from the scope of the current invention. The following detailed description is, therefore, not to be taken in a limiting sense. The scope of the current invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Turning to FIGS. 1-5, a manifold 10 constructed in accordance with an embodiment of the invention is illustrated. The manifold 10 broadly comprises a primary body 12 and a gate 14.

The primary body 12 broadly comprises a first inlet channel 16, first inlet connecting geometry 18, a second inlet channel 20, second inlet connecting geometry 22, a third inlet channel 24, third inlet connecting geometry 26, a first outlet channel 28, a second outlet channel 30, outlet connecting geometry 32, and a gate cavity 34.

The first inlet channel 16 receives a first substance from a first substance source and allows the first substance to pass to the gate 14. The first inlet channel 16 extends to the gate cavity 34 and may be a straight channel or may have a number of bends or turns. The first inlet channel 16 may be drilled or molded into the primary body 12.

The first inlet connecting geometry 18 allows the first substance source to be connected to the primary body 12 at the first inlet channel 16. The first inlet connecting geometry 18 may be a male or female helical threaded connection, a friction fit connection, or any other suitable connecting geometry.

The second inlet channel 20 receives a second substance from a second substance source and allows the second substance to pass to the gate 14. The second inlet channel 20 extends to the gate cavity 34 and may be a straight channel or may have a number of bends or turns. The second inlet channel 20 may be drilled or molded into the primary body 12.

The second inlet connecting geometry 22 allows the second substance source to be connected to the primary body 12 at the second inlet channel 20. The second inlet connecting geometry 22 may be a male or female helical threaded connection, a friction fit connection, or any other suitable connecting geometry.

The third inlet channel 24 receives a third substance from a third substance source and allows the third substance to pass to the gate 14. The third inlet channel 24 extends to the gate cavity 34 and may be a straight channel or may have a number of bends or turns. The third inlet channel 24 may be drilled or molded into the primary body 12. The third inlet channel 24 may be positioned between the first inlet channel 16 and the second inlet channel 20.

The third inlet connecting geometry 26 allows the third substance source to be connected to the primary body 12 at the third inlet channel 24. The third inlet connecting geometry 26 may be a male or female helical threaded connection, a friction fit connection, or any other suitable connecting geometry.

The first outlet channel 28 allows the first substance to be distributed to a nozzle or other dispensing component. The third outlet channel 28 extends from the gate cavity 34 and may be a straight channel or may have a number of bends or turns. The first outlet channel 28 may be drilled or molded into the primary body 12.

The second outlet channel 30 allows the second substance to be distributed to the nozzle or other dispensing component. The second outlet channel 30 extends from the gate cavity 34 and may be a straight channel or may have a number of bends or turns. The second outlet channel 30 may be drilled or molded into the primary body 12.

The outlet connecting geometry 32 allows the nozzle to be connected to the primary body 12 at the first and second outlet channels 28, 30. The outlet connecting geometry 32 may be may be a male or female helical threaded connection, a friction fit connection, or any other suitable connecting geometry.

The gate cavity 34 retains the gate 14 and may be a cylindrical space extending through the primary body 12. The gate cavity 34 extends at least to the first inlet channel 16, second inlet channel 20, third inlet channel 24, first outlet channel 28, and second outlet channel 30.

The gate 14 switches between flow of the first and second substances and flow of the flushing fluid through the outlet channels 28, 30. The gate 14 broadly comprises a first through-channel 36, a second through-channel 38, a third through-channel 40, a handle 42, and stop 44. The gate 14 may be configured to pivot or shift in relation to the primary body 12.

The first through-channel 36 extends through the gate 14 so as to connect the first inlet channel 16 to the first outlet channel 28 when the gate 14 is in a substance delivery position. The first through-channel 36 may be drilled or molded into the gate 14.

The second through-channel 38 extends through the gate 14 so as to connect the second inlet channel 20 to the second outlet channel 30 when the gate 14 is in the substance delivery position. The second through-channel 38 may be drilled or molded into the gate 14.

The third through-channel 40 extends through the gate 14 so as to connect the third inlet channel 24 to the first outlet channel 28 and second outlet channel 30 when the gate 14 is in a flushing position. The third through-channel 40 may be Y-shaped or may widen toward its downstream end so as to form a path with from the third inlet channel 24 to both the first outlet channel 28 and the second outlet channel 30. The third through-channel 40 may be angled or offset from the first through-channel 36 and second through-channel 38 so that the first through-channel 36 and second through-channel 38 do not form paths at the same time as the third through-channel 40.

The handle 42 extends from the gate 14 and allows a user to switch the gate 14 between the substance delivery position and the flushing position. The handle 42 may include a grip, knob, high friction material, or other feature for allowing a user to more positively control the handle 42. The handle 42 may pivot, rotate, shift and may provide a mechanical advantage for making the gate 14 easier to switch between positions.

The stop 44 limits the movement of the gate 14 between the substance delivery position and the flushing position and may be a combination protrusion and groove or other limiting geometry. For example, the gate may have a groove and the primary body 12 may have a set pin configured to extend into the groove, with the extents of the groove preventing the gate 14 from shifting past the substance delivery position and the flushing position.

Use of the manifold 10 will now be described in more detail. First, the manifold 10 may be connected to a first substance source via the first inlet connecting geometry 18 and connected to a second substance source via the second inlet connecting geometry 22. The manifold 10 may also be connected to a pressurized air, gas, or other fluid source. The manifold 10 may also be connected to a nozzle via the outlet connecting geometry 32. Alternatively, the manifold 10 may have an integrated nozzle.

The gate 14 may be initially in the substance delivery position (FIGS. 2 and 3) such that the first through-channel 36 connects the first inlet channel 16 to the first outlet channel 28 and connects the second inlet channel 20 to the second outlet channel 30. First and second substances may then be dispensed through the manifold 10 with the gate 14 in the substance delivery position.

The gate 14 may then be shifted to the flushing position (FIGS. 4 and 5) such that the third through-channel 40 connects the third inlet channel 24 to the first outlet channel 28 and the second outlet channel 30. Pressurized air, gas, or other fluid may then be released from the fluid source so as to pass through the manifold 10 and flush out the first outlet channel 28 and second outlet channel 30. This prevents the substances from mixing and hardening inside the first outlet channel 28, second outlet channel 30, and/or nozzle. A grease gun could also be connected to the third inlet channel 24 for filling the channels with grease when the manifold 10 is not in use.

The above-described manifold 10 provides several advantages. For example, the manifold 10 can be cleared of substances by shifting the gate 14 from the substance delivery position to the flushing position via the handle 42. This is simpler, less time consuming, and more thorough than inserting a drill or other tool into passageways to clear the substances. The manifold 10 also does not need to be discarded after one or only a few uses. The manifold 10 can also be formed such that the channels curve smoothly from inlet to outlet instead of forming ninety-degree bends and other fluid restrictions so as to improve substance delivery performance.

Figure 6:
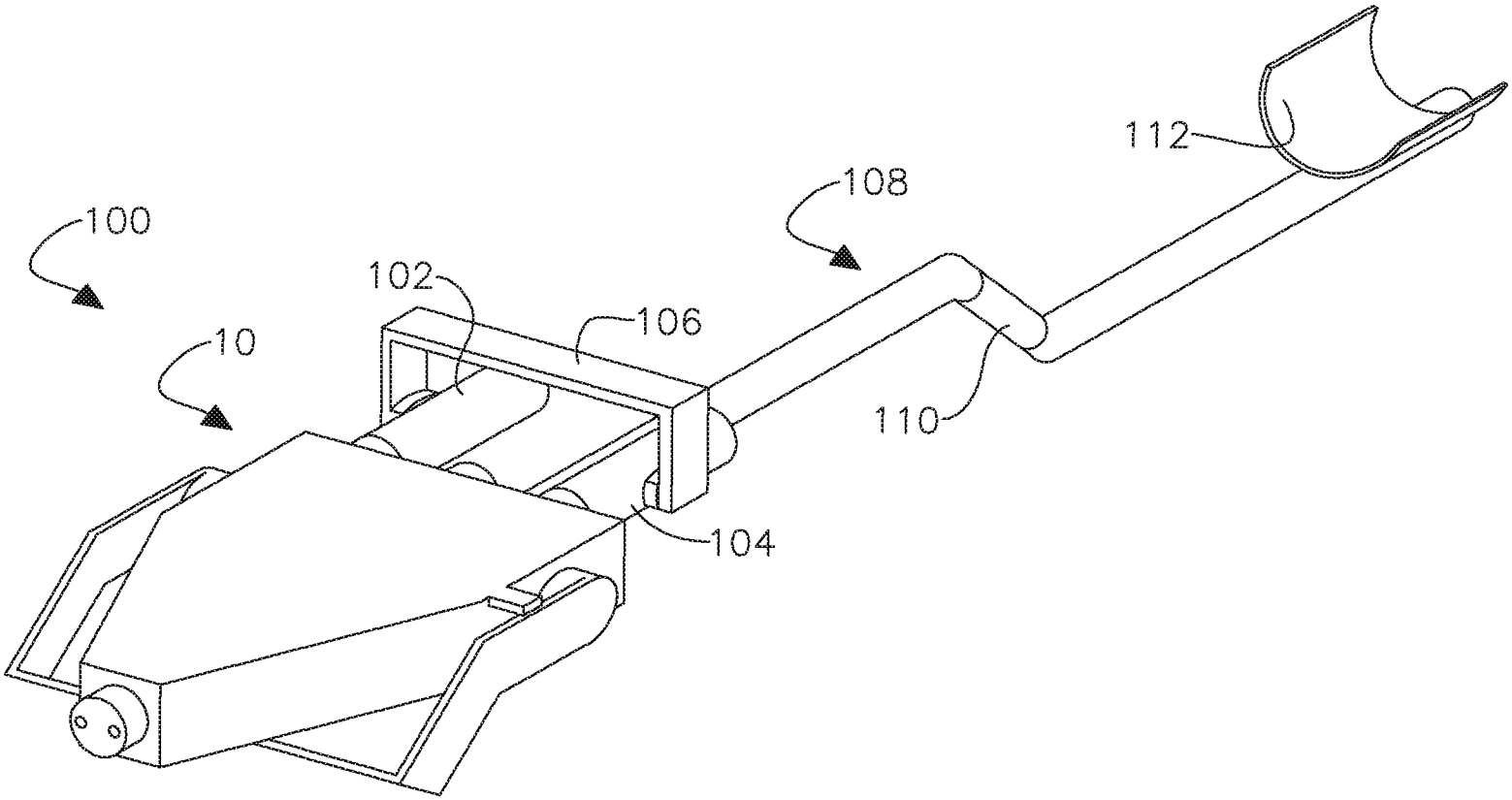
FIG. 6 is a perspective view of a material applicator including the manifold of FIG. 1.

Turning to FIG. 6, another embodiment is a material applicator 100 broadly comprising a manifold 10 as described above, first and second material dispensing valves 102, 104, a valve bridge handle 106, and an extension arm 108. The first material dispensing valve 102 is connected to the first inlet channel via the first inlet connecting geometry and the second material dispensing valve 104 is connected to the second inlet channel via the second inlet connecting geometry. The material dispensing valves 102, 104 may be ball valves or any other suitable type of valve. The material dispensing valves 102, 104 allow the user to control flow of the first and second substances to the manifold 10 and allow the substances to be shut off from the manifold 10 when the manifold 10 is being flushed. The valve bridge handle 106 connects the first and second dispensing valves 102, 104 such that the valves 102, 104 are actuated simultaneously. The extension arm 108 extends from the manifold 10 and includes a hand grip 110 and a forearm rest 112. The hand grip 110 allows the user to aim the manifold 10 and the forearm rest 112 balances the weight of the manifold 10 against the user's forearm. The hand grip 110 and forearm rest 112 may include foam pads or other suitable components for improving grip and comfort.

Although the present invention has been described with reference to the embodiments illustrated in the attached drawing figures, it is noted that equivalents may be employed and substitutions made herein without departing from the scope of the present invention as recited in the claims.

Having thus described various embodiments of the present invention, what is claimed as new and desired to be protected by Letters Patent includes the following:

1. A manifold comprising:
a primary body comprising:
a first inlet channel for receiving a first substance;
a second inlet channel spaced from the first inlet channel for receiving a second substance;
a third inlet channel spaced from the first and second inlet channels for receiving a pressurized flushing fluid;
at least one outlet channel for delivering the first substance and/or the second substance; and
a gate cavity, the first, second, and third inlet channels extending into the gate cavity and the at least one outlet channel extending from the gate cavity; and
a gate at least partially positioned in the gate cavity, the gate comprising:
a first through-channel configured to connect the first inlet channel to the at least one outlet channel when the gate is in a substance delivery position; and
a second through-channel configured to connect the second inlet channel to the at least one outlet channel when the gate is in the substance delivery position;
a third through-channel configured to connect the third inlet channel to the at least one outlet channel when the gate is in a flushing position,
the manifold being configured to allow the first substance to be delivered from the first inlet channel to the at least one outlet channel and the second substance to be delivered from the second inlet channel to the at least one outlet channel when the gate is in the substance delivery position and to allow the flushing fluid to be delivered to the at least one outlet channel when the gate is in the flushing position.

2. The manifold of claim 1, wherein the primary body further comprises first connecting geometry near the first inlet channel for connecting a first substance conduit to the first inlet channel, second connecting geometry near the second inlet channel for connecting a second substance conduit to the second inlet channel, third connecting geometry near the third inlet channel for connecting a flushing fluid conduit to the third inlet channel, and fourth connecting geometry near the at least one outlet channel for connecting a dispensing nozzle to the at least one outlet channel.

3. The manifold of claim 1, wherein the gate is configured to disconnect the first inlet channel and second inlet channel from the at least one outlet channel when the gate is shifted to the flushing position.

4. The manifold of claim 1, wherein the gate is configured to be pivoted between the substance delivery position and the flushing position.

5. The manifold of claim 1, wherein the gate further comprises a handle for allowing a user to shift the gate between the substance delivery position and the flushing position.

6. The manifold of claim 1, wherein the primary body and/or the gate further comprise a stop for restricting movement of the gate between the substance delivery position and the flushing position.

7. The manifold of claim 1, wherein the at least one outlet channel comprises a first outlet channel and a second outlet channel, the first through-channel being configured to connect the first inlet channel to the first outlet channel and the second through-channel being configured to connect the second inlet channel to the second outlet channel when the gate is in the substance delivery position.

8. A material applicator comprising:
a manifold comprising:
a primary body comprising:
a first inlet channel for receiving a first substance;
a second inlet channel spaced from the first inlet channel for receiving a second substance;

a third inlet channel spaced from the first and second inlet channels for receiving a pressurized flushing fluid;

at least one outlet channel for delivering the first substance and/or the second substance; and a gate cavity, the first, second, and third inlet channels extending into the gate cavity and the at least one outlet channel extending from the gate cavity; and a gate at least partially positioned in the gate cavity, the gate comprising:

a first through-channel configured to connect the first inlet channel to the at least one outlet channel when the gate is in a substance delivery position;

a second through-channel configured to connect the second inlet channel to the at least one outlet channel when the gate is in the substance delivery position; and a third through-channel configured to connect the third inlet channel to the at least one outlet channel when the gate is in a flushing position, the manifold being configured to allow the first substance to be delivered from the first inlet channel to the at least one outlet channel and the second substance to be delivered from the second inlet channel to the at least one outlet channel when the gate is in the substance delivery position and to allow the flushing fluid to be delivered to the at least one outlet channel when the gate is in the flushing position;

a first substance source configured to be connected to the first inlet channel;

a second substance source configured to be connected to the second inlet channel;

a flushing fluid source configured to be connected to the third inlet channel; and a dispensing nozzle configured to be connected to the manifold for dispensing the first substance and the second substance.

9. The material applicator of claim 8, wherein the primary body further comprises first connecting geometry near the first inlet channel for connecting the first substance source to the first inlet channel, second connecting geometry near the second inlet channel for connecting the second substance source to the second inlet channel, third connecting geometry near the third inlet channel for connecting the flushing fluid source to the third inlet channel, and fourth connecting geometry near the at least one outlet channel for connecting the dispensing nozzle to the at least one outlet channel.

10. The material applicator of claim 8, wherein the gate is configured to disconnect the first inlet channel and second inlet channel from the at least one outlet channel when the gate is shifted to the flushing position.

11. The material applicator of claim 8, wherein the gate is configured to be pivoted between the substance delivery position and the flushing position.

12. The material applicator of claim 8, wherein the gate further comprises a handle for allowing a user to shift the gate between the substance delivery position and the flushing position.

13. The material applicator of claim 8, wherein the primary body and/or the gate further comprise a stop for restricting movement of the gate between the substance delivery position and the flushing position.

14. The material applicator of claim 8, wherein the at least one outlet channel comprises a first outlet channel and a second outlet channel, the first through-channel being configured to connect the first inlet channel to the first outlet channel and the second through-channel being configured to connect the second inlet channel to the second outlet channel when the gate is in the substance delivery position.

15. The material applicator of claim 8, further comprising a first substance delivery valve connected to the first inlet channel for selectively controlling flow of the first substance to the manifold and a second substance delivery valve connected to the second inlet channel for selectively controlling flow of the second substance to the manifold.

16. The material applicator of claim 15, further comprising a valve bridge handle connected to the first substance delivery valve and the second substance delivery valve such that the first substance delivery valve and second substance delivery valve are actuated together.

17. The material applicator of claim 15, further comprising an extension arm having a hand grip for allowing a user to aim the manifold and a forearm rest for allowing the user to balance the weight of the manifold against his forearm.

* * * * *